United States Patent [19]

Ortelli

[11] 4,181,067

[45] Jan. 1, 1980

[54] DISTRIBUTOR FOR HYDRAULIC MOTORS

[75] Inventor: Aurelis Ortelli, Bologna, Italy

[73] Assignee: Riva Calzoni S.p.A., Milan, Italy

[21] Appl. No.: 878,645

[22] Filed: Feb. 17, 1978

[30] Foreign Application Priority Data

Feb. 17, 1977 [IT] Italy ..... 20386/77

[51] Int. Cl.[2] ..... F01B 1/06

[52] U.S. Cl. ..... 91/485; 91/480

[58] Field of Search ..... 91/491, 487, 180

[56] References Cited

U.S. PATENT DOCUMENTS

| | | | |
|---|---|---|---|
| 2,969,810 | 1/1961 | Dudley | 91/485 |
| 3,056,357 | 10/1962 | Bohnhoff | 91/480 |
| 3,090,361 | 5/1963 | Orshansky, Jr. | 91/485 |
| 3,199,297 | 8/1965 | Croswhite | 91/491 |
| 3,696,710 | 10/1972 | Ortelli | 91/180 |

*Primary Examiner*—William L. Freeh

*Attorney, Agent, or Firm*—Sughrue, Rothwell, Mion, Zinn and Macpeak

[57] ABSTRACT

A distributor for hydraulic motors, particularly radial-piston hydraulic motors, wherein an excellent hydraulic seal is provided in the area between the motor housing and the fluid distribution plate by the utilization of a tubular sleeve located in front of the distribution plate. At least two annular steps located on said sleeve which engage with corresponding annular steps on the housing provide such seal.

5 Claims, 6 Drawing Figures

DISTRIBUTOR FOR HYDRAULIC MOTORS

The present invention refers to a distributor for hydraulic motors, in particular for radial-piston hydraulic motors, of the type disclosed in U.S. Pat. No. 3,696,710.

According to the prior art, distributors for hydraulic motors of the above mentioned type consist of a hollow housing co-axially secured to one side of the casing at one end of the driving shaft, which extends inside said housing, a distribution plate connected to said end of driving shaft and rotating therewith inside the hollow housing, and a plurality of ducts obtained in said plate and cyclically communicating on their one end with the feed and drain ducts of the radial pistons of the motor and on their other end with corresponding ducts on the walls of said fixed housing for the feeding and discharge of the hydraulic fluid.

According to said prior art there have been serious troubles in separating the feeding flow from the discharge flow and vice versa in those areas where the ducts on said plate rotating inside the hollow housing and the fixed feeding and discharge ducts on the walls of the housing itself are connected.

In fact, according to the prior art, the cavity of the fixed housing is divided into two sections being respectively connected with the discharge and/or feeding flows through an annular element placed between the distribution plate and the front wall opposite to the end of the driving shaft, said annular element being secured to said housing wall, for example, by means of pins, with the interposition of toroidal washers which, besides providing a sealing action in the contact area, also provide an elastic thrust, especially when the motor is started, to press the distribution plate against the motor casing when this thrust action is not yet provided by the pressure of the hydraulic fluid, thus preventing leakage between the contact surfaces of said annular piece and said plate.

In order to allow the toroidal washers to carry out the above listed functions, it is necessary to make use of elements as much as possible devoid of end floats, i.e. to work with considerably close tolerances.

However, when the motor is running and due to said close tolerances, seizures of the moving parts have been so frequent as to make this distributor unsuitable.

The present invention is therefore based on the problem of providing an excellent hydraulic seal in the contact area of feeding and discharge between the ducts of the fixed housing and those of the distribution plate rotating in the cavity of said housing, thus providing a sharp separation between the feeding and the discharge flow as well as suitable thrust of the plate against the motor casing at the starting of the motor, when no hydraulic pressure is present as yet, without the risk of seizures between the moving parts.

This problem is solved according to the invention, by a sleeve like tubular element inserted between said distribution plate and the housing wall perpendicular to the rotation axis of the driving shaft, the external periphery of said sleeve like tubular element having at least two annular steps thereon which are in engagement with corresponding annular steps on said fixed housing wall, with the interposition of respective toroidal seals, said sleeve like tubular element being secured to said housing by locking means which prevent it from rotating while allowing its axial displacement and being also provided with a plurality of holes in the area between said two steps, said holes communicating, at the one side, with a first feeding and/or discharge duct on the fixed housing wall and, at the other side, with an annular groove on said distribution plate, the axial cavity of said sleeve like tubular element communicating, at one end, with a second feeding and/or discharge duct on the housing wall and, at the other end, with a cavity on the opposite surface of the distribution plate, an elastic means for pressing said sleeve like tubular element against said distribution plate being also provided.

In a preferred embodiment of the invention, said two annular steps on the external periphery of said sleeve like tubular element are radially spaced between each other by an annular shoulder whose surface area is substantially equal to the hydraulically active surface area of the central part of the sleeve like tubular element.

The distributor according to the invention provides the advantage of sharply separating the feeding flow from the discharge flow in the passage between the rotating distribution plate and the adjacent fixed housing wall, and thus assures an excellent seal without risk of seizure between the moving parts, since the toroidal seals, by acting radially between opposite cylindrical and not flat surfaces, allow the construction of the pieces with sufficiently large tolerances.

There is a further advantage, in that the same toroidal seals do not have to carry out any biasing action against the distribution plate, as this biasing action is carried out by separate elastic means, when the device is still not running.

Finally, especially in the preferred embodiment of the invention, in which the annular surface area of the annular shoulder between the peripheral steps on the sleeve like tubular element is equal to the hydraulically active surface area of the central part of said sleeve like tubular element, there is the further advantage that the hydraulic thrust on the distribution plate does not change when the motor is running, whichever is the direction of rotation of the motor and therefore whichever duct in the fixed housing is used for feeding or discharge.

The invention will now be further described with reference to the accompanying drawings, by way of example, in which.

Figure 2:
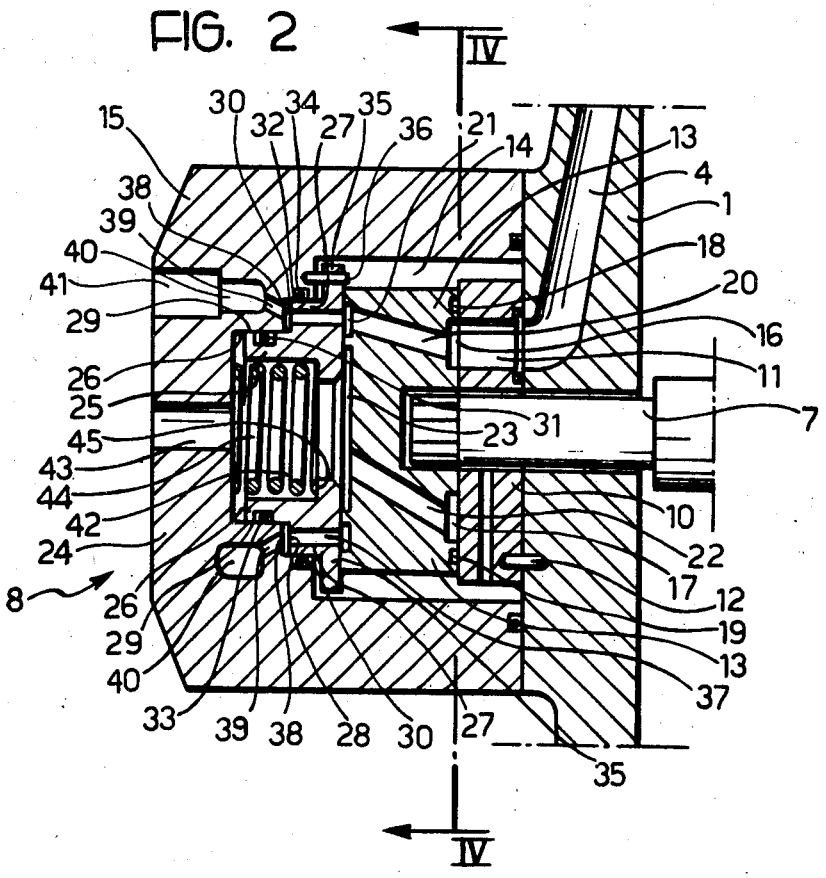
FIG. 2 is a schematic vertical section of the distributor taken along a plane through the rotation axis of the driving shaft.
Figure 1:
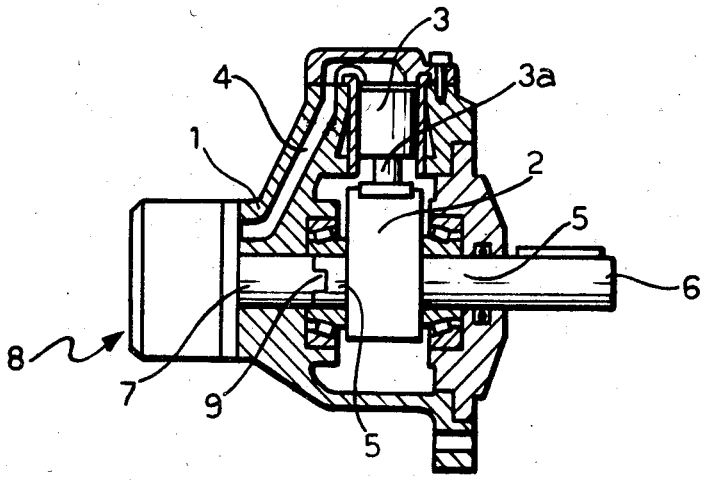
FIG. 1 is a schematic section of a radial piston motor for which the distributor according to the invention is particularly suitable.
Figure 3:
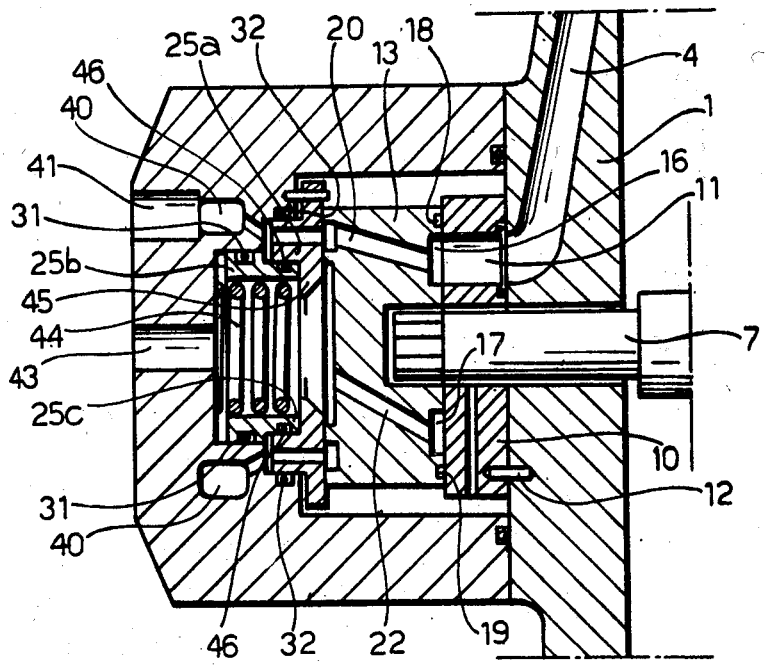
FIG. 3 is a schematic vertical section of the distributor of FIG. 2 in a modified embodiment.
Figure 5:
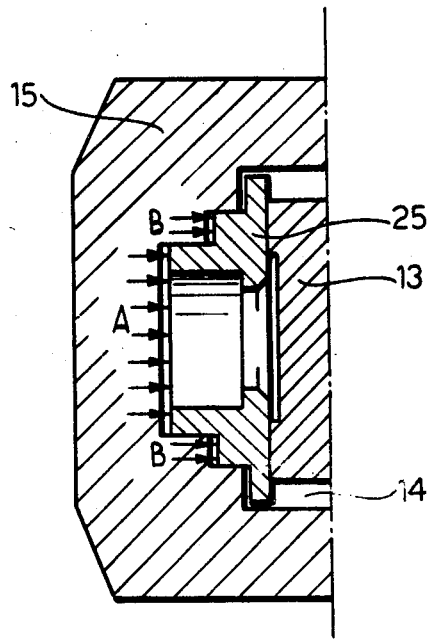
Figure 6:
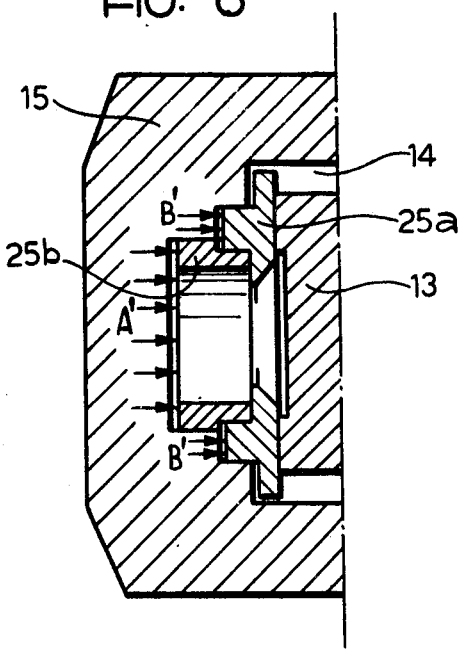

FIGS. 5 and 6 schematically show the distribution of the hydraulical thrust in the embodiments of FIGS. 2 and 3 respectively.

With reference to the above figures, 1 is the side wall of the casing of an hydraulic motor, whose rotor 2 is rotated by a plurality of hydraulic cylinders 3 having pistons 3*a* spaced along the periphery of the rotor and fed with hydraulic fluid through corresponding channels 4. Rotor 2 is mounted on driving shaft 5, having a power take-off 6 projecting at one end from the casing and a section 7 extending at the opposite end inside the distributor, by interposing a joint 9, if necessary, said distributor being indicated by 8 as a whole. A more detailed example of said motor may drawn from Italian Pat. No. 812059 by the same Applicant.

With particular reference to FIG. 2, section 7 of the driving shaft passes through a flat body 10 secured to the casing wall 1 and provided with passages for the fluid, like the one indicated by 11, which are connected with duct 4 for the feeding cylinders 3.

Said flat body is locked by pins 12 against rotation with respect to casing wall 1.

On the free end of section 7 of shaft 5 is mounted a distribution plate 13 which rotates with shaft 5 and is timed with the desired hydraulic distribution on cylinders 3. Body 10 and plate 13 are both lodged in cavity 14 of box-type housing 15 of distributor 8.

Figure 4:
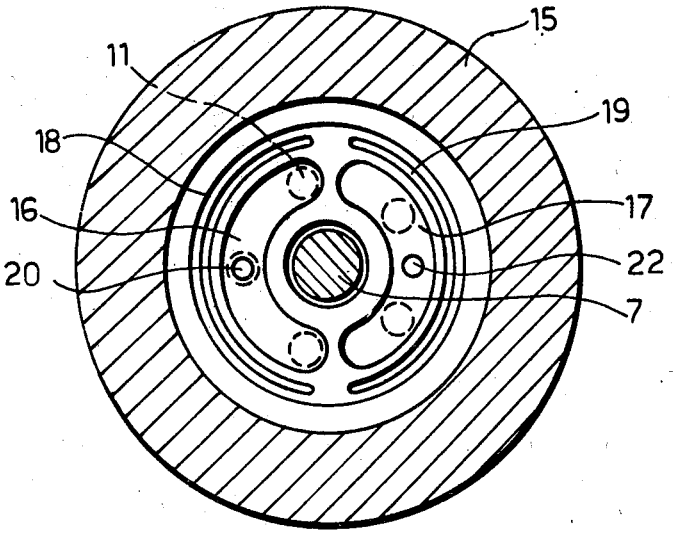
FIG. 4 is a section along line IV—IV of FIGS. 2 and 3.

Distribution plate 13 has, on its surface facing body 10, a first pair of arcuate grooves 16 and 17 and a second pair of arcuate grooves 18 and 19 having reduced transverse size with respect to said first grooves. Further details concerning these grooves may be seen in FIG. 4, which is a plan view thereof. While grooves 18 and 19 are provided for balancing the hydraulic thrust in conventional way, adjacent grooves 16 and 17 are provided for cyclically connecting ducts 4 for feeding and/or discharge of hydraulic cylinders 3.

In fact, groove 16 is in communication with a duct 20 which leads though the whole thickness of distribution plate 13 to an annular open groove 21 on the surface opposite to the one which is contact with body 10. Groove 17, on the other hand, is in communication with a further duct 22 leading through the whole thickness of plate 13 to an open cavity 23 in the center of plate 13 inside annular groove 21.

Between plate 13 and vertical wall 24 of casing 15 there is a sleeve like tubular element 25 having two annular steps 26 and 27 radially spaced by an annular shoulder 28. Said sleeve like tubular element 25 is inserted in a corresponding cavity of wall 24 having corresponding steps 29 and 30. Between steps 26 and 27 of the sleeve like tubular element 25 and the corresponding steps 29 and 30 of wall 24 of the fixed housing 15, there are toroidal washers 31 and 32 lodged in annular grooves 33 and 34 respectively, the first washer being located, for instance, on the sleeve like tubular element 25 and the second on the wall of fixed housing 15.

The same sleeve like tubular element 25 is also provided with a flange 35 to secure said tubular element 25 to casing 15 through pin 36, which prevents rotation while allowing a limited axial displacement with respect to wall 24.

Corresponding to annular shoulder 28 there are holes 37 which communicate on one side with annular groove 21 and on the other side with annular cavity 38 formed by shoulder 28 and wall 24.

Ducts 39 end inside said cavity 38 and are reciprocally connected by a toroidal cavity 40 communicating with the feeding and/or discharge hole 41 through wall 24.

The central part of the sleeve like tubular element 25 forms an axial cavity 42 which communicates on one side with feeding/or discharge hole 43 through wall 24, and on the other side with open cavity 23 provided on the opposite surface of distribution plate 13.

In the same axial cavity 42 lodges a helicoidal spring 44 baised on one side against wall 24 and on the other side against annular edge 45 on the sleeve like tubular element 25.

With reference to the modified embodiment of FIG. 3, the sleeve like tubular element consists of two pieces 25*a* and 25*b* telescopically jointed by a cylindrical portion 25*c* with the further interposition of a toroidal washer 46.

This modified embodiment offers the advantage of making the enlargement of the annular thrust surface possible without need to increase the external diameter of the distributor.

In fact, according to this embodiment, the annular thrust surface extends between external washer 32 and internal washer 46, being radially displaced towards the distributor axis.

With reference to FIGS. 5 and 6, it is finally observed that the thrust, indicated by A and A′ as a whole, applied to the hydraulically active surface area of the central part of sleeve like tubular elements 25 and 25*b* equals the thrust applied to annular shoulder 28, indicated by B and B′ respectively. These thrusts A–A′ or B–B′ have to balance those deriving from distribution plate 13 in the opposite direction.

This means that, when the motor is running, whichever of holes 41 or 43 is used for feeding the fluid under pressure and whichever is the direction of rotation of the motor, the sleeve like tubular elements 25 or 25*a*, 25*b* are pressed against the distribution plate 13 always with the same force.

As to the hydraulic feeding and the discharge of cylinders 3, this operation is carried out in a conventional way as may be understood from the accompanying drawings and from the preceding description.

As to the function the sleeve like tubular elements 25 or 25*a*, 25*b*, it should be pointed out that, when the motor is started and there is no pressure yet in cavity 42 or in cavity 38, the thrust against distribution plate 13 is exerted by spring 44 which thus assures a sealing connection between the sleeve like tubular element and the rotating distributor plate 13 as well as between the latter and fixed body 10.

When the motor is running, to the above thrust the one of forces A–A′ or B–B′ is added according to the direction of feeding of the fluid under pressure; both thrusts are counter-balanced by those exerted in opposite direction by distribution plate 13.

As to the sealing connection between feeding passages and discharge passages in the connecting section between distribution plate 13 and wall 24 of the fixed housing 15, this is assured by toroidal washers 31 and 32, as well as 46, which are in their best operating conditions since their action is exerted radially between opposite cylindrical surfaces and not between flat surfaces as in the prior art. Moreover, these washers allow an axial displacement of the pieces, for example in case of sudden temperature changes, without impairing the sealing functions and without risk of seizure.

What is claimed is:

1. Distributor for hydraulic motors, in particular for radial-piston hydraulic motors, comprising:

(a) a hollow housing laterally secured to the motor casing coaxially with one end of the driving shaft extending inside the cavity of said housing;

(b) a distributor plate connected to said end of the driving shaft and rotating therewith inside the cavity of said housing;

(c) a plurality of ducts on said plate cyclically communicating at one end, with the feeding and discharge ducts of the radial pistons of the motor and, at the other end, with corresponding ducts for feeding and discharging the hydraulic fluid under pressure;

(d) a pair of sleeve like tubular elements telescopically disposed relative to each other and located between said distributor plate and the wall of said housing coaxially with the rotation axis of the shaft of the motor, each of said sleeve like tubular elements having on its external periphery an annular step which engages corresponding annular steps on said wall of the fixed housing;

(e) means for securing said sleeve like tubular element to said housing which prevent it from rotating while permitting it an axial displacement;

(f) a plurality of holes on said sleeve like tubular element in the intermediate area between said two steps, said holes communicating at the one side with a first feeding or discharge duct in the wall of the fixed housing and, at the other side, with an annular groove on said distribution plate, the axial cavity of said sleeve like tubular element communicating, at one end, with a second feeding or discharge duct on the wall of the housing and, at the other end, with a cavity on the opposite surface of the distribution plate; and (g) elastic means for pressing said sleeve like tubular element against said distribution plate.

2. Distributor as claimed in claim 1, wherein said elastic means is a helicoidal spring lodged in the axial cavity of one of said sleeve like tubular elements, biased, on one side, against the wall of the fixed housing and, on the other side, against an inner annular shoulder of said one of said sleeve like tubular elements.

3. Distributor as claimed in claim 1, wherein there are provided toroidal seals between the annular steps on said sleeve like tubular elements and the annular steps on said wall of the fixed housing.

4. Distributor as claimed in claim 3, wherein said toroidal seals fit into respective annular grooves on the wall of said fixed housing.

5. Distributor as claimed in claim 3, wherein said toroidal seals fit into respective annular grooves on the periphery of said steps of said sleeve like tubular elements.

* * * * *